US007724131B2

(12) United States Patent
Chen

(10) Patent No.: US 7,724,131 B2
(45) Date of Patent: May 25, 2010

(54) SYSTEM AND METHOD OF REPORTING ALERT EVENTS IN A SECURITY SYSTEM

(75) Inventor: Hong-Jyh Chen, Woodbury, NY (US)

(73) Assignee: Honeywell International Inc., Morristown, NJ (US)

( * ) Notice: Subject to any disclaimer, the term of this patent is extended or adjusted under 35 U.S.C. 154(b) by 293 days.

(21) Appl. No.: 12/106,004

(22) Filed: Apr. 18, 2008

(65) Prior Publication Data

US 2009/0261967 A1 Oct. 22, 2009

(51) Int. Cl.
*G08B 29/00* (2006.01)

(52) U.S. Cl. ..... 340/506; 340/541

(58) Field of Classification Search ..... 340/506, 340/541, 539.1, 825.36, 825.49
See application file for complete search history.

(56) References Cited

U.S. PATENT DOCUMENTS 6,060,994 A * 5/2000 Chen ..... 340/506
6,281,790 B1 * 8/2001 Kimmel et al. ..... 340/506
6,917,288 B2 * 7/2005 Kimmel et al. ..... 340/506
7,046,142 B2 * 5/2006 Hershkovitz et al. ..... 340/541
7,167,094 B2 * 1/2007 Ciarcia et al. ..... 340/541
7,242,295 B1 * 7/2007 Milinusic et al. ..... 340/541
2007/0085676 A1 4/2007 Lee et al.

FOREIGN PATENT DOCUMENTS

WO WO 02/03284 A1 1/2002

* cited by examiner

*Primary Examiner*—John A Tweel, Jr.
(74) *Attorney, Agent, or Firm*—Husch Blackwell Sanders Welsh & Katz

(57) ABSTRACT

A system and method for reporting alert events to a terminal device of a user of the security system. In one aspect, a security device of the system generates data of an image or a video clip indicative of an alert event in a detection zone of the security system and further generates a message including an indicium associated with the data. A security control panel of the system receives the message including an indicium associated with the data, identifies an address associated with the terminal device, and sends an instruction message including the indicium and the address to the security device. Upon receiving the instruction message, the security device generates an alert message including the data based on the indicium, and sends the alert message to the address of the user device.

16 Claims, 2 Drawing Sheets

SYSTEM AND METHOD OF REPORTING ALERT EVENTS IN A SECURITY SYSTEM

FIELD OF THE INVENTION

This invention relates generally to security systems and more particularly to a system and method for reporting the occurrence of an alert event to a user of the system.

BACKGROUND OF THE INVENTION

Security systems offer a degree of security for residential sites and for office, business, or industrial applications. Typically, a security device monitoring a protected area, such as a sensor or a camera, is provided as part of a security system for detecting the occurrence of various alerting events, such as a breach of the protected area, a fire condition, or other types of condition, and generating alarm signals or data indicative of the events. The signals or data are transmitted through wire or wireless connections to a security control panel configured for processing the alarm signals or data from the security device and implementing other functionalities based on the processed results of the alarm signals or data, such as arming the system, disarming the system, providing system status and generating alerting messages indicative of the events, coordinating the operations of different functional modules of the system, and so on.

In addition, a central monitoring station may be provided to communicate with the security control panel for receiving, routing and sending the messages generated by the control panel to the terminal devices of the users of the security system, notifying them the occurrence of alerting events. An example of the security system is disclosed in the commonly assigned U.S. patent application Ser. No. 11/252,667. Accordingly, the entirety of the U.S. patent application Ser. No. 11/252,667 is incorporated herein by reference.

Generally, users expect events notifications of not only pure text but also multimedia information, such as pictures, audio clips and video clips. However, in the event that a large file, such as a video clip captured by a camera, needs to be transferred in the form of a message to the users of the security system, the file has to be transferred to the security control panel and subsequently processed by the security control panel to generate an alert message and further send the message to the central station. Thus, it is required that the security control panel be equipped with a memory of sufficient capacity to store the file and a microprocessor of high performance, which in turn increases the overall cost of the security system. Specifically, compared to pure text files, the multimedia files including video clips and/or audio clips require much larger storing capacities and higher information processing capacities of the security control panel.

In addition, the traditional event reporting scheme involves data/files transportation from the security device to the security control panel, which increases the communication burden of the whole system and incurs a long data transferring time.

Thus, it is desirable to have a system and method for reporting alert events to the users of the system efficiently, without demanding high performance hardware of the system.

BRIEF SUMMARY OF THE INVENTION

According to one aspect of the present invention, a security system for reporting alert events to a terminal device of a user of the security system is provided. The security system includes a security device configured to generate data in response to an occurrence of an alert event in a detection zone of the security system and generate a message including an indicium associated with the data and a security control panel configured to receive the message including an indicium associated with the data, identify an address associated with the terminal device, and send an instruction message including the indicium and the address to the security device. The security device generates an alert message including the data based on the indicium, and sends the alert message to the address of the user device.

According to another aspect of the present invention, a method of reporting alert events to a terminal device of a user of a security system is provided. The method includes the steps of receiving a message including an indicium associated with data generated in response to an occurrence of an alert event in a detection zone of the security system, identifying an address associated with the terminal device, and sending an alert message including the data to the address of the terminal device.

A program storage device readable by a machine, tangibly embodying a program of instructions executable by the machine to perform the above-described method steps is also provided.

DETAILED DESCRIPTION OF THE INVENTION

The present invention now will be described in detail hereinafter with reference to the accompanying drawings, in which exemplary embodiments of the invention are shown. However, this invention may be embodied in many different forms and should not be construed as limited to the embodiments set forth herein. Like numerals refer to like elements throughout.

As used herein, "configured to" and the like refer to mechanical or structural connections between elements to allow the elements to cooperate to provide a described effect; these terms also refer to operation capabilities of electrical elements such as analog or digital computers or application specific devices that are programmed to perform a sequence of steps to provide an output in response to given input signals.

Figure 1:
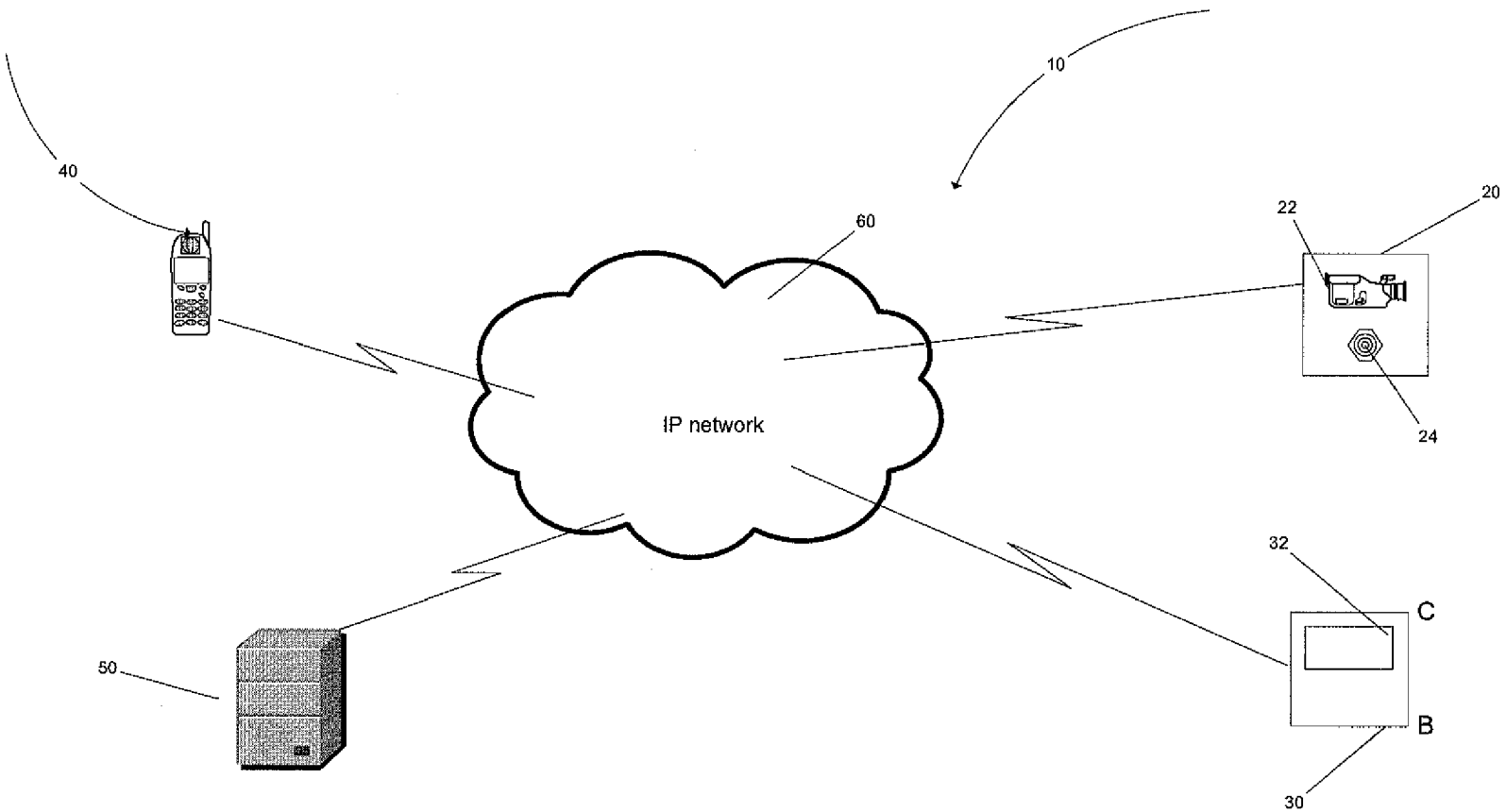
FIG. 1 is a block diagram illustrating the architectural overview of a security system reporting alert events to a user's terminal device via a network, according to one exemplary embodiment of the present invention.

FIG. 1 is a block diagram illustrating a security system 10 according to one exemplary embodiment of the present invention, which communicates with a user's terminal device 40 via an IP network 60. The security system 10 is generally configured to detect the occurrence of a predefined alert event and notify the user of the occurrence of the event through a message, such as an email or SMS.

The system 10 includes at least one security device 20 configured to detect an event, such as a breach of a protected premise, and transmit signals in response to the event. The system 10 further includes a security control panel 30 in communication with the security device 20 through the IP network 60, for processing the signals from the security device and controlling the operations of other functional modules of the system. Specifically, the security control panel 30 has the capability of intelligently determining whether an alert message or signal should be sent to a user of the system based on the signals from the security device 20 and further instructing the security device 20 to send out an alert message or signal to the user if it is determined that an alert message or signal should be sent to the user.

In addition, a central monitoring station 50 is in communication with the security control panel 30 through the IP network 60. According to an aspect of the present invention, the alert event, alarm condition or any other type of security breach could also be notified to the central station 50 in addition to notifying the user by generating and sending a message for the user. The central station 50 is capable of reporting the alert events to, for example, the police or security personnel by sending messages or alarms to them.

The security device 20 includes but is not limited to sensors, cameras, microphones, or the combination of the foregoing. For example, an IP (Internet Protocol) camera 22 configured to capture image data to generate video streams and/or a plurality of still images of the detection area can be provided to obtain information indicative of an alert event. Such captured data may be saved and transmitted as MPEG, JPEG, or many other types of data via wire or wireless connections and may be compressed or encrypted before transmission. The IP camera 22 captures and transmits live images directly over the IP network 60, enabling authorized users to locally or remotely view, store, and manage video clips over standard IP-based network infrastructure.

Furthermore, the IP camera 22 has the capability of generating and sending messages to the security control panel 30 upon the occurrence of an alert event. For example, the IP camera 22 may have inherent motion detecting capability by processing video streams and/or still images captured by itself to determine whether to generate and send a message to the security control panel 30. This process can be implemented by comparing two or more consecutive images to detect any abrupt changes of the images. When it is determined by the IP camera 22 that a breach has been detected based on processing the captured images, the IP camera 22 is triggered to generate and send an initial message to the security control panel 30.

Alternatively, the IP camera 22 may be provided with a built-in sensor, or an external sensor coupled to the camera through wire or wireless connection for triggering the generating and sending of an initial message. For example, a PIR (Passive Infrared) sensor 24 is coupled electrically to the IP camera 22 for detecting a breach of the monitored region. If the PIR sensor 24 detects an occurrence of a breach, the PIR sensor 24 sends a triggering signal to the IP camera 22. Upon receiving the triggering signal, the IP camera 22 captures images of the detection region and further sends an initial message to the security control panel 30.

Optionally, a more advanced IP camera can be provided by combining the inherent motion detection feature with a motion sensor, which would greatly enhance the reliability of the entire security system.

In the exemplary embodiment of the invention, the IP camera 22 is also configured to generate a tag number corresponding to an image or a video clip after the image or the video clip is captured by the IP camera 22 when a breach has been detected in the monitored region. For example, the IP camera 22 has the capability of generating a tag number for identifying a captured image at the moment of breach. The tag number may contain a time stamp indicative of the time when the image is captured. The tag number may further contain information for the security control panel 30 to identify a terminal device of the user. The captured images are further saved for the IP camera 22 to subsequently generate an alert email containing live video streams and/or still pictures descriptive of the breach.

The IP camera 22 sends the message with the tag number corresponding to the captured image or video clip to the security control panel 30 through the IP network 60, which can be the Internet.

The security control panel 30 intelligently determines whether an alert message should be sent to the user based on the message sent from the IP camera 22. In the event it is determined that an alert message should be sent to the terminal device 40 of the user to notify the user occurrence of a breach, the security control panel 30 identifies the address of the terminal device.

Subsequently, the security control panel 30 generates and sends an instruction message to the IP camera 22 over the IP network 60, instructing the IP camera 22 to generate and send an alert message corresponding to the alert event to the terminal device 40. For instance, the instruction message includes the address of the terminal device 40 identified by the security control panel 30, the tag number designated to a specific image or video clip. Furthermore, the security control panel 30 also provides an interface 32 to allow a third party to interact with the security control panel 30 to edit the instructions to the IP camera and to further control the operation of the IP camera. For instance, a security system maintenance person or technician is able to enter commands to edit the alert message through editing the instruction messages, such as adding text to the alert message descriptive of the nature of the alert event. In addition, the instructions can enable controlling the sending of the alert message, such as synchronizing the message sent by the IP camera.

Upon receiving the instruction message from the security control panel 30, the IP camera 22 obtains from the instruction message, the address of the terminal device 40, the tag number of a specific image or video clip, and other information, such as the text of an alert message. Upon receiving the instruction message, the IP camera 22 generates an alert message incorporating the image or video clip designated by the tag number and the text, and sends the alert message directly to the address of the terminal device 40 through the IP network 60.

Optionally, the IP camera 22 generates and sends an acknowledgment message or negative acknowledgment message to the security control panel 30 indicating success or failure of sending the alert message to the terminal device 40 of the user.

In this way, an alert message that includes images or video clips is generated and sent to the terminal device 40 by the IP camera 22 through the IP network 60, without having the security control panel 30 temporarily storing the video clip files. The security control panel 30 functions to control and coordinate the sending of the alert messages from the IP camera to the terminal device. Thus, there is no need for the security control panel to hold the images or video clips before sending them to the user. Moreover, the steps of transferring the files from the IP camera to the security control panel and from the security control panel to the terminal device are obviated. Accordingly, it is not necessary for the security control panel to be equipped with large capacity memories for temporarily storing the files. Furthermore, the time for transferring the files is greatly shortened.

In the security system shown in the exemplary embodiment of the invention, the terminal device 40 may be any device that is enabled to communicate with the security system, for example, over the Internet. Examples of such devices may includes but are not limited to personal digital assistants (PDAs), cellular telephones, email messaging devices and the like.

Figure 2:
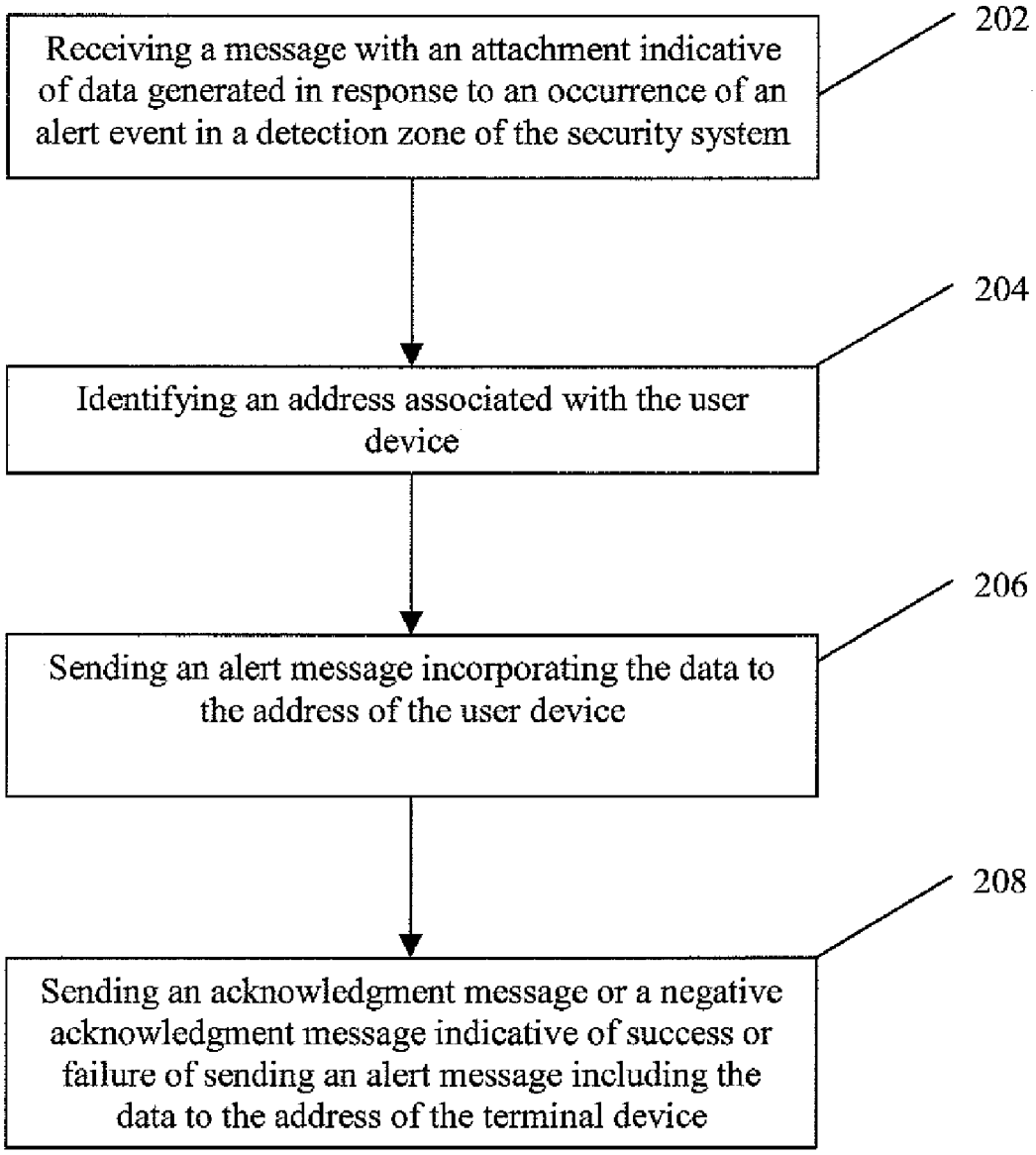
FIG. 2 is a flow chart illustrating the method of reporting alert events to a user's terminal device, according to another exemplary embodiment of the present invention.

FIG. 2 is a flow chart illustrating the method of reporting alert events to a user's terminal device, according to another exemplary embodiment of the present invention.

At step 202, a message having a tag number corresponding to an image or video clip captured by an IP camera when an alert event occurs in a detection zone of the security system is received by a security control panel.

At step 204, an address associated with a terminal device of a user is identified by the security control panel if it is determined that an alert message should be sent to the user.

At step 206, an alert message incorporating the image or video clip is sent to the address of the user terminal device by the IP camera. Optionally, text can be edited into the alert message, describing the nature of the alert event.

At step 206, an acknowledgment message or a negative acknowledgment message indicating success or failure of sending the alert message including the data to the address of the terminal device is sent to the security panel.

The invention has been described herein with reference to particular exemplary embodiments. Certain alterations and modifications may be apparent to those skilled in the art, without departing from the scope of the invention. The exemplary embodiments are meant to be illustrative, not limiting of the scope of the invention, which is defined by the appended claims.

What is claimed is:

1. A security system for reporting alert events to a terminal device of a user of the security system, comprising:

a security device configured to generate data in response to an occurrence of an alert event in a detection zone of the security system and generate a message including an indicium associated with the data; and a security control panel configured to receive the message including an indicium associated with the data, identify an address associated with the terminal device based on the message, and send an instruction message including the indicium and the address to the security device, wherein the security device generates an alert message including the data based on the indicium, and sends the alert message to the address of the terminal device.

2. The security device of claim 1, wherein the security device comprises an IP camera configured to generate data of an image or a video clip corresponding to the event.

3. The security device of claim 1, wherein the security control panel comprises an interface allowing a third party to add text to the instruction message, the text further added to the alert message by the security device after the security device receives the instruction message.

4. The security device of claim 1, wherein security control panel comprises an interface allowing a third party to control the security device to send an alert message.

5. The security device of claim 4, wherein security control panel comprises an interface allowing a third party to synchronize the sending of the alert message.

6. The security device of claim 1, wherein the alert message comprises an email sent to the terminal device of the user over an Internet provider.

7. The security device of claim 2, wherein the indicium of the data comprises a tag number associated with the image or video clip.

8. The security device of claim 1, wherein the security device generates an acknowledgment message or a negative acknowledgment message indicative of success or failure of sending the alert message to the address of the user device.

9. A method of reporting alert events to a terminal device of a user of a security system, comprising the steps of:

receiving a message including an indicium associated with data generated in response to an occurrence of an alert event in a detection zone of the security system;

identifying an address associated with the terminal device; and sending an alert message including the data to the address of the terminal device.

10. The method of claim 9, wherein the data generated in response to an occurrence of an alert event in a detection zone of the security system comprises data of an image or a video clip captured by an IP camera.

11. The method of claim 10, wherein the sending an alert message including the data to the address of the user device is performed by said IP camera.

12. The method of claim 9, wherein the identifying an address associated with the terminal device is performed by a security control panel.

13. The method of claim 9, further comprising adding text descriptive of the alert event to the alert message.

14. The method of claim 9, further comprising sending an acknowledgment message or a negative acknowledgment message indicative of success or failure of sending the alert message including the data to the address of the terminal device.

15. The method of claim 9, wherein the alert message comprises an email sent over an Internet provider.

16. A program storage device readable by a machine, tangibly embodying a program of instructions executable by the machine to perform a method of reporting alert events to a terminal device of a user of a security system, comprising:

receiving a message including an indicium associated with data generated in response to an occurrence of an alert event in a detection zone of the security system;

identifying an address associated with the terminal device; and sending an alert message including the data to the address of the terminal device.

* * * * *